US005321967A

United States Patent [19]

Wakabayashi

[11] Patent Number: 5,321,967

[45] Date of Patent: Jun. 21, 1994

[54] METHOD OF EXTRUDING ALUMINUM ALLOY AND DIES THEREFOR

[75] Inventor: Fusao Wakabayashi, Chigasaki, Japan

[73] Assignee: Isuzu Motors Limited, Tokyo, Japan

[21] Appl. No.: 918,452

[22] Filed: Jul. 22, 1992

[30] Foreign Application Priority Data

Jul. 29, 1991 [JP] Japan ..... 3-210518

[51] Int. Cl.[5] ..... B21C 25/08

[52] U.S. Cl. ..... 72/260

[58] Field of Search ..... 72/260, 468

[56] References Cited

U.S. PATENT DOCUMENTS 2,231,336 2/1941 Heron ..... 72/260

*Primary Examiner*—Lowell A. Larson

*Attorney, Agent, or Firm*—Gottlieb, Rackman & Reisman

[57] ABSTRACT

A method for extruding molded members with section forms thereof that are partially varied along the extruded axis is provided. The method comprises the steps of extruding members in sectional form by extruding a material from a die hole for molding a sectional form of a maximum area assumed, and extruding members gradually forming different sectional forms by extruding a material while gradually changing the die hole sectional area.

8 Claims, 14 Drawing Sheets

METHOD OF EXTRUDING ALUMINUM ALLOY AND DIES THEREFOR

FIELD OF INVENTION

This invention relates to an extruding method for members partially different in open section form, such as for example vehicle structural members including structural members for load-carrying platforms, or aluminum alloy members used for building construction, such as sashes and showcase frames, and to dies to be used for extruding thereof.

BACKGROUND OF THE INVENTION

In order to meet the requirement for lightweight vehicles, a method for replacing vehicle members conventionally formed by steel with lightweight aluminum alloy is employed. A material with its specific weight reduced to a steel ratio of ⅓ is used in general. As measures against a decrease in Young's modulus and material proof stress, as shown in FIG. 25, a closed section structure 20 or a closed section formed by laminating miscellaneous-shape members of a concave groove structure 30 and a plate 31 are used.

In case of mounting parts 11 and 12 on either side of a molded member 10 molded by conventional steel with open section, as shown in FIG. 26, parts 11 and 12 were installed on either side of the molded member 10, which were fixed with fasteners. As shown in FIG. 27, when an aluminum alloy closed section member 20 was introduced, the part 11 was fixed on one side of the aluminum alloy closed section member 20. So the other part 12 should be mounted on the other side wall 21 of the alloy closed section member 20. When the parts 11 and 12 are the members with heavy load, these connections are not proper to bear such heavy load.

When aluminum alloy extruded moldings were used for vehicle structural members, the conventional extruding method could not mold members with substantial changes in form. For this reason, aluminum alloy extrusion molded members used for automobile chassis and load-carrying platforms were members of a constant section form assuring a maximum stress area. As shown in FIG. 28, in case of constant section form member 40, section A is formed to bear the maximum stress. Though section B is loaded lightly, section B is formed to be the same to section A, resulting in over capacity and reducing efficiency of material use.

Furthermore, with a conventional steel chassis 50, a vehicle mainframe member 51 was disposed in layout shown in FIG. 29, while the use of an aluminum alloy closed section member 52 for the chassis resulted in disposition shown in FIG. 30, thus necessitating total modification of the layout.

With vehicle sashes for buses, etc., showcase and building sashes for which aluminium alloy extrusion molded members were used in various ways, a channel material, with a constant section, required after-machining of run-in in shaping up of sashes for visual correction and appearance modification thereof.

In this context, an extrusion molding method has been required for extrusion molded members with section forms varied along its extrusion axis.

As an extrusion molding method for extrusion molded members with section forms thereof changed along its extrusion axis, a method for manufacturing stepped tubes has been disclosed in the Japanese patent gazette Appl. No. H1-192,414. This method involves forming a mandrel head so as to have multiple steps, thereby allowing the mandrel head part partially different in diameter to go into and out of die holes, and thus manufacturing a tube 60 with a constant peripheral diameter with the inner wall thickness partially changed (Refer to FIG. 31).

Furthermore, a method for forming a protruding portion 71 in the periphery of an extrusion rod 70 shown in FIG. 32 has been disclosed in the Japanese patent gazette Appl. No. H2-48,324. This method involves forming a space 76 in the rear of a die hole 74 of a fixed die 72 shown in FIG. 33, usually forming by extrusion an extrusion rod 70 of the die hole 74, protruding, when forming the protruding portion 71, a mobile die 78, and filling billets in the space 76 forming the protruding portion 71.

SUMMARY OF THE INVENTION

These manufacturing methods, however, relating to manufacturing of hollow structural members and members manufactured thereby respectively had inconveniences described in the paragraph of the Prior Art. To cope with this, the present invention offers a molding method for arbitrarily providing change in the section form for aluminum alloy extruded materials, extruded materials in open section form, in particular, and dies to be used for the method.

Means to Solve Problems

The method of the present invention for extruding molding members with section form thereof partially varied along its extruded axis comprises a process step for extruding members in maximum sectional form by extruding a material from a die hole for molding a sectional form of a maximum area assumed and a process step for extruding members gradually forming different sectional forms by extruding a material while gradually changing the die hole sectional area.

The dies to extrude members whose sectional form is partially different comprise dies continuously disposed in a container with die holes formed in accordance with a maximum assumable member form and dies with die holes to form a member form when connected to the die holes of the fixed die and dies disposed so as to slide within the range of the die holes of the fixed dies.

A member gradually varied in sectional form is formed when a material is extruded from die holes formed by the die holes of the fixed dies and the die holes of the slidable dies slidably engaged with the die holes of the fixed dies varying the sectional area of the die hole.

DETAILED DESCRIPTION OF THE PREFERRED EMBODIMENT OF THE INVENTION

The invention will now be described in detail with reference to the drawings.

EXAMPLE 1

Figure 1:
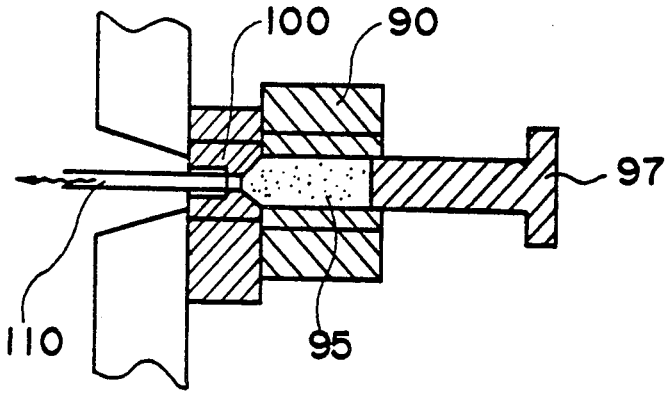
FIG. 1 is an explanatory drawing of the main units of an extruding machine to operate the present invention.
Figure 2:
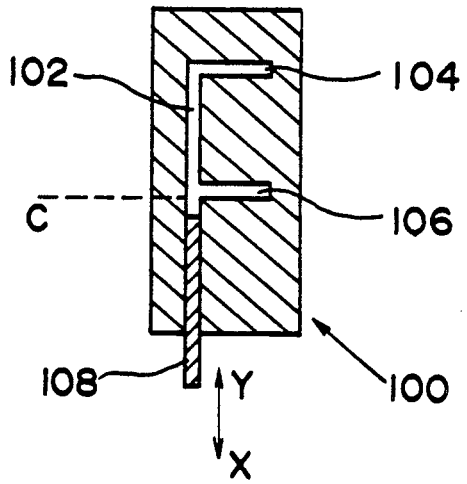
FIG. 2 is an explanatory drawing of a die section.
Figure 3:
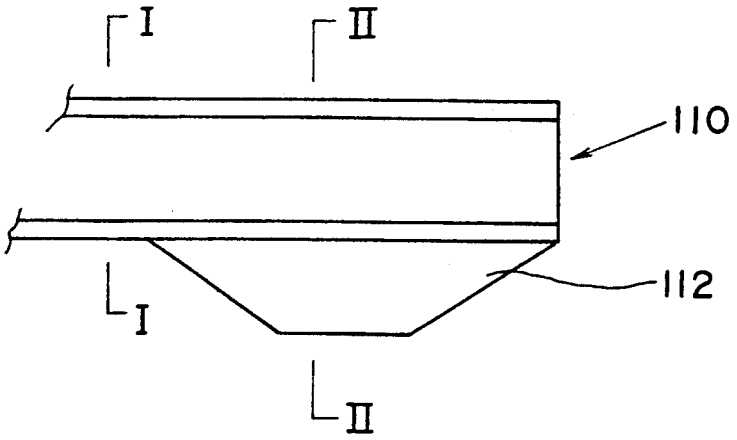
FIG. 3 is a front elevation of an extruded member.

FIGS. 1 to 8 show explanatory drawings of the example 1. FIG. 1 is an explanatory drawing of the main units of an extrusion molding machine operating this example.

A die 100 is fixed at one end of a container 90 which contains billets 95. A ram 97 is pressed into the die 100 to cause billets 95 to be extruded from the die hole of the die 100 for forming a molding 110 with its sectional form equal to the die hole sectional area.

The die 100 in this example has the following die holes shaped therein: a first die hole 102, a second die hole 104 disposed in succession at right angle to the upper end of the first die hole 102 and a third die hole 106 disposed at right angle in an intermediate position of the die hole 102. A plate-shaped slidable core 108 is inserted into the die hole 102 from thereunder.

The machine is composed so as for plate-shape slidable core 108 to be inserted into the first die hole 102 to slide in X and Y directions and for the opening area of the die hole 102 of the die 100 to be controlled by controlling a sliding rate of the plate-shape slidable core 108.

With the use of the die 100 of such composition the plate-shape slide core 108 was first installed at the lower end C of the third die hole 106, the plate-shape slide core 108 was controlled to gradually slide in arrow X direction and then in arrow Y direction after retaining a descending position for a predetermined time.

Figure 4:
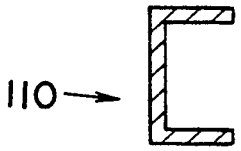
FIG. 4 is a sectional view of the line I—I in FIG. 3.
Figure 5:
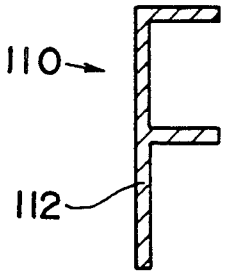
FIG. 5 is a sectional view of the line II—II in FIG. 3.

The sectional forms of the molding 110 extruded by this method are shown in FIGS. 4 and 5. That is, a basic sectional form is the channel section formed by the first die hole 102, the second die hole 104 and the third die hole 106 with a U-shape tilted 90 deg. to the right. As the plate-shape slide core 108 is allowed to slide down, a taper-shaped protruded part 112 is formed at the lower end of the basic sectional form.

Figure 6:
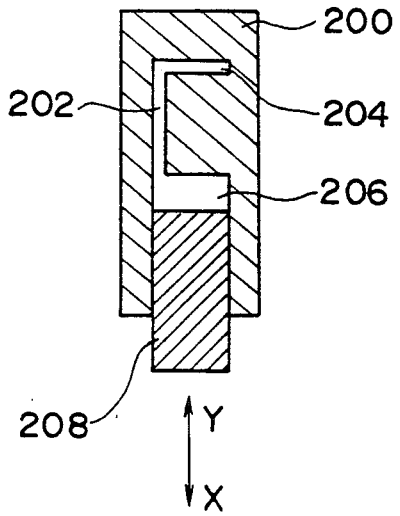
FIG. 6 is an explanatory drawing of a die section.
Figure 7:
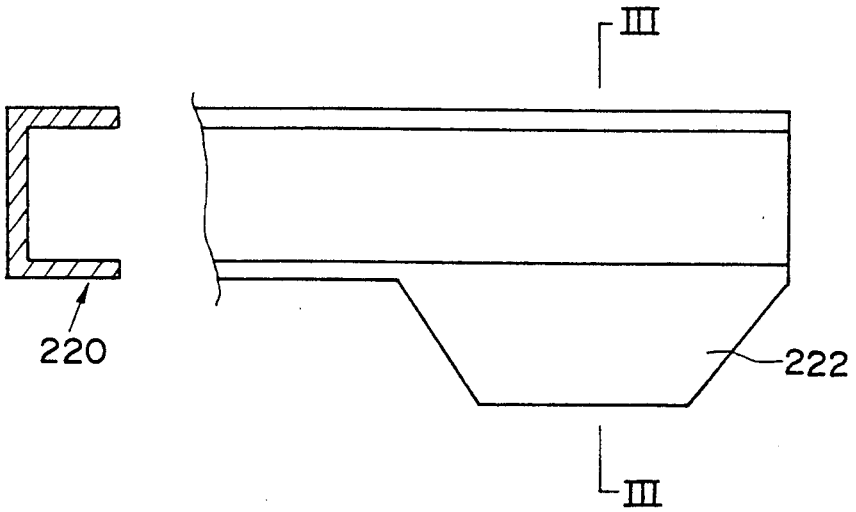
FIG. 7 is a front elevation of an extruded member.
Figure 8:
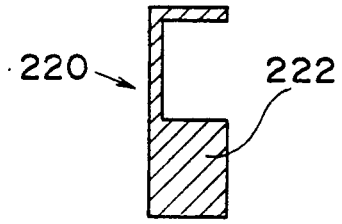
FIG. 8 is a sectional view of the line III—III.

In the next place, changing the wall thickness of one side of a basic form with a U tilted 90 deg. to the right as its section will be described (Refer to FIGS. 6 to 8).

A die 200 to be used in this extruding method forms a second die hole 204 disposed at right angle at the upper end of a first die hole 202, and a third die hole 206 has as its die hole the dimension between the central part of the die hole 202 and the second die hole 204 in the lower part of the die hole 202. The third die hole 206 is provided with a slidable core 208 to fit therein. The opening area of the die hole 206 is controlled by sliding the slide core 208 in the die hole 206.

Operating the machine using the die 200 of such composition enables a taper-shape board thickness area 222 with gradually enlarged wall thickness to be formed on one side of a basic form 220 with the channel sectional form of a U tilted 90 deg. to the right.

As described above, by using combination die set with a fixed die and a slidable core to vary the die hole sectional area, extrusion of a member with its sectional form varied along its extruded axis can be achieved.

EXAMPLE 2

This example provides a method for extruding molding with its sectional form expanded or contracted while keeping the sectional wall thickness constant. Also, this example provides a method of extruding molding with its wall thickness varied along its extrusion axis.

Figure 9:
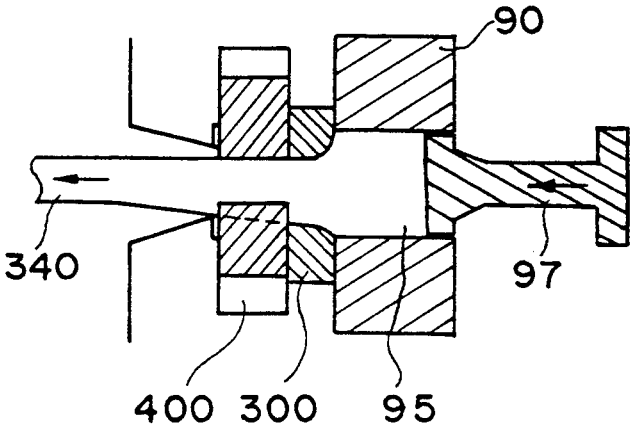
FIG. 9 is an explanatory drawing of the main units of another extruding machine to operate the present invention.

FIG. 9 is an explanatory drawing of the main units of an extrusion molding machine operating this method.

The dies in this example include a fixed die 300 fixed on a container 90 and a slidable die 400 slidable against the fixed die 300. As is the same with the process in the example 1, aluminum alloy billets 95 in the container 90 are pressed by a ram 97 to extrude the billets 95 out of the die hole, thereby obtaining a molding.

Figure 10:
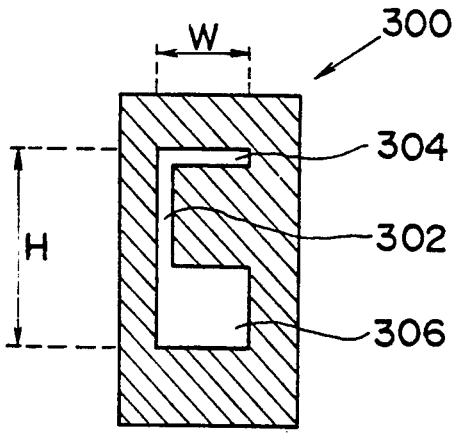
FIG. 10 is an explanatory drawing of a fixed die section.
Figure 11:
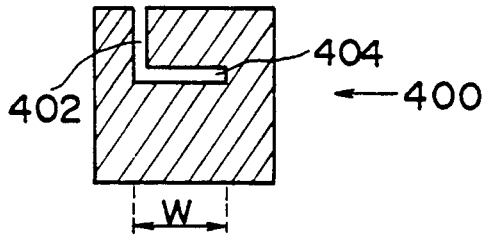
FIG. 11 is an explanatory drawing of a slidable die section.

The dies in this example will be described referring to FIGS. 10 to 12.

The fixed die 300 has a first die hole 302, a second die hole 304 formed in dimension W at right angle from the upper end of the first die hole 302 and a third die hole 306 formed in width dimension W of the second die hole 304 from the lower end of the first die hole 302. The dimension between the upper end of the first die hole 302 and the lower end of the third die hole 306 is dimension H, dimension H and dimension W being the maximum sectional dimensions of a molding assumed.

A slidable die 400 is formed with a first die hole 402, and a second die hole 404 with a dimension of W.

An extruding method for a molding with its sectional form varied by an extrusion molding machine provided with the fixed die 300 and the slidable die 400 will be described.

Figure 12:
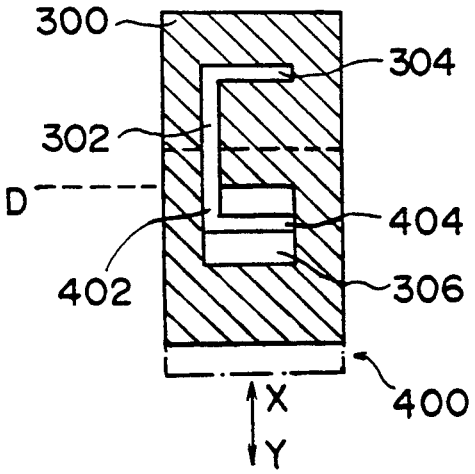
FIG. 12 is an explanatory drawing of a combined state of a fixed die and a slidable die.

FIG. 12 shows a state where the slidable die 400 is disposed at the back of the fixed die 300 so as to be slidable in arrows X and Y directions.

In the first step, the first die hole 402 of the slidable die 400 is allowed to agree with the first die hole 302 of the fixed die 300, and the upper end of the second die hole 404 of the slidable die 400 is allowed to agree with the upper end position D of the third die hole 306 of the fixed die 300. In the second step, the slidable die 400 is gradually slid in arrow Y direction. The slidable die 400 is lowered to the lower end of the third die hole 306 of the fixed die 300. In the third step, extrusion is continued to the end.

Figure 13:
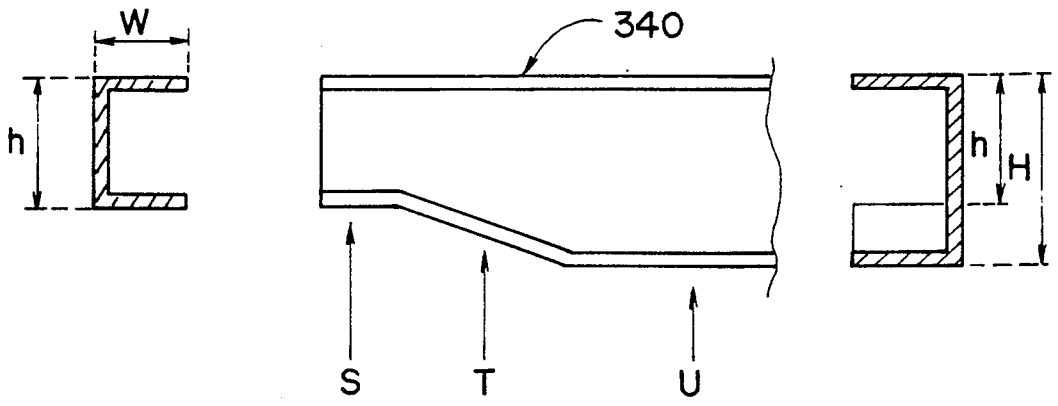
FIG. 13 is a front elevation of a extruded member.
Figure 14:
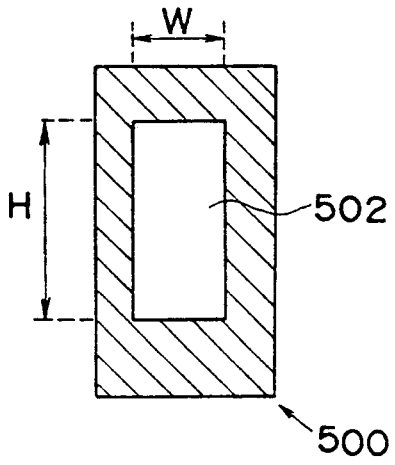
FIG. 14 is an explanatory drawing of a fixed die section.
Figure 15:
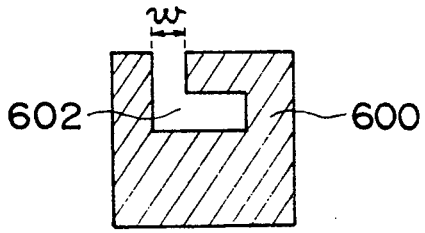
FIG. 15 is an explanatory drawing of a first slidable die section.
Figure 16:
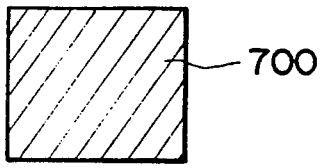
FIG. 16 is an explanatory drawing of a second slidable die section.
Figure 17:
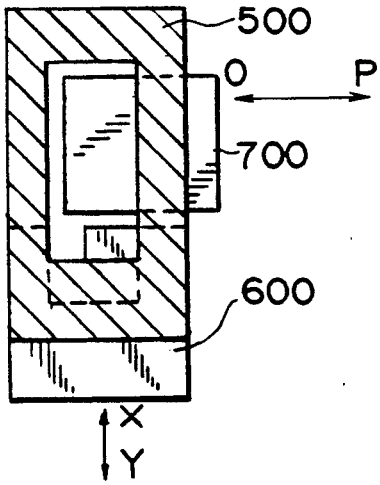
FIG. 17 is an explanatory drawing of a combined state of a fixed die and a first and second slidable dies.

A molding 340 formed in such operation is shown in FIG. 13. That is, in the first step, an area S is formed when a material is extruded through the die hole defined by the second die hole 304, the first die hole 302 of the fixed die 300 and the second die hole 404 of the slidable die 400 in its upper position. The section of this area has a basic form, having dimension h in height and W in width, of a U-shape tilted 90 deg. to the right. In the second step, a taper-area T is formed when a material is extruded through the die hole defined by the second die hole 304, the first die hole 302 of the fixed die 300, and the first die hole 402 of the slidable die 400 which enlarges the opening area with the movement of the slidable die 400 slided in Y direction and the second slidable die. In the third step, an area with maximum width dimension H of the molding 340, is formed when a material is extruded from the die hole formed by the second die hole 304, the first die hole 302 of the fixed die 300, and the longest first die hole 402 of the slidable die 400 which has moved down to the bottom. This method enables the width dimension to be changed from dimension h to dimension H without changing the wall thickness of the molding 340.

In the next place, a case where a section form is enlarged and the wall thickness d of molding is simultaneously varied will be described referring to FIGS. 14 to 17.

In this case, a combination die set is comprised of a fixed die 500 with a die hole 502 with the assumed maximum area, a first slidable die 600 with an L-shape die hole 602 with the assumed maximum wall thickness width w and a second slidable die 700 to go in and out in the range of the die hole 502. As against the fixed die 500 attached on the container, the first slidable die 600 is disposed so that it is free to slide in arrows X and Y directions, and the second slidable die 700 is disposed so that it is free to slide in arrows O and P directions.

In an extrusion molding machine of such composition, a molding with constant wall thickness and gradually increased width dimension is molded by moving the first slidable die 600 in arrow Y direction. In addition, a molding with dimension w as a maximum wall thickness is molded by moving the second slidable die 700 in arrow P direction.

EXAMPLE 3

An example of extruding a channel frame whose sectional form is changed through constant stress control by the extrusion molding method shown in the above examples will be described here by comparing a conventional example shown in FIG. 18.

Figure 18:
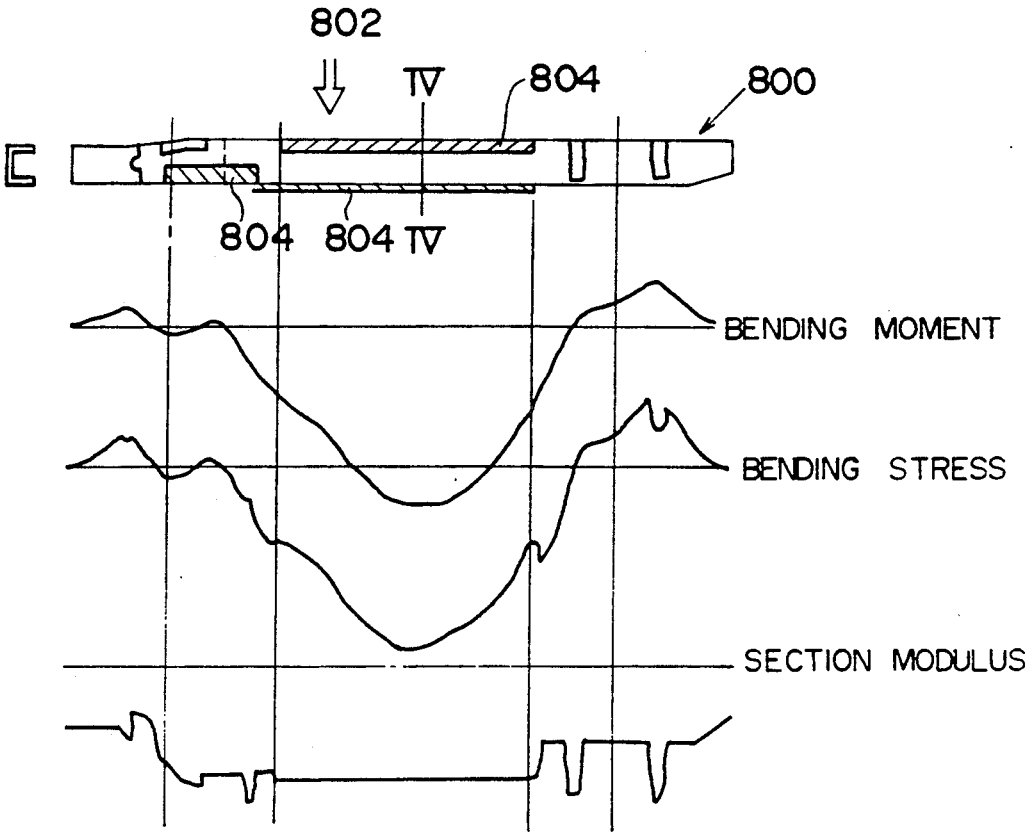
FIG. 18 is an explanatory drawing of characteristics of an existing steel sheet press molding.
Figure 19:
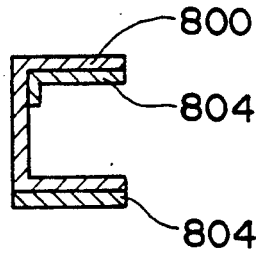
FIG. 19 is a sectional view of the line IV—IV in FIG. 18.

FIG. 18 shows a channel frame 800 formed by existing steel plate press molding. The channel frame 800 has characteristics of bending moment, bending stress and section modulus shown in FIG. 18. A bending moment reduced portion 802 was coped with by attaching reinforcing plates 804 to the top and the bottom of the frame 800 or the corner area thereof. In this way, the total weight of the conventional channel frame 800 used to be considerably great with respect to the weight of the material thereof to which the load of the reinforcing plate 804 was added.

Figure 20:
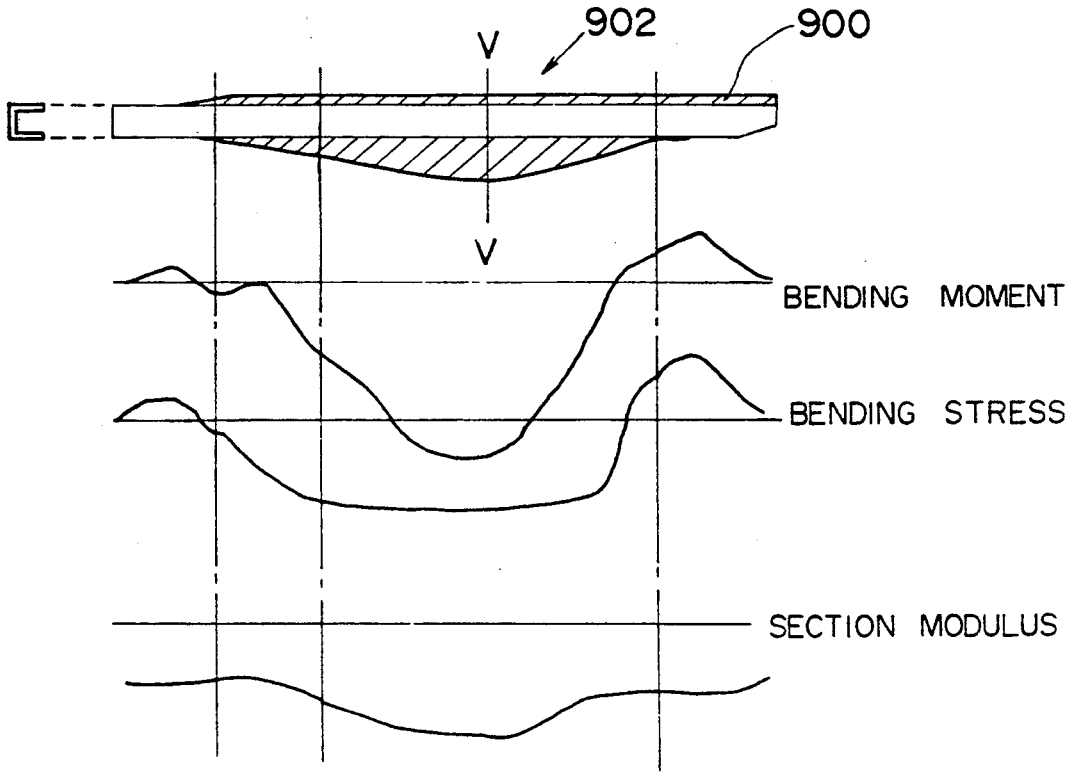
FIG. 20 is an explanatory drawing of characteristics of an aluminum alloy member produced by the method of the present invention.

FIG. 20 shows an aluminum alloy channel frame 900 formed by extrusion molding of the present invention.

Figure 21:
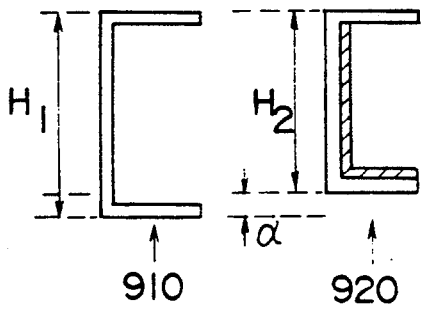
FIG. 21 is an explanatory drawing of the line V—V part.

A bending moment bearing portion 902 of the aluminum alloy channel frame 900 can be coped with by expanding the section width by gradually sliding the slidable die from the basic form having a section with a U tilted 90 deg. to the right shape and thereby obtaining a molding 910 having, as shown in FIG. 21, a maximum sectional form with dimension H1 as the width dimension thereof. Furthermore, a molding 920 is extruded by sliding the second slidable die 700 and by varying the wall thickness of the channel frame 900 so as to be thickened in the shadowed portion.

The advantage of this molded channel 920 is to enlarge thickness of the wall on any desired section where stress is applied. So, in case of this channel 920, with width H2 which is smaller than H1 of the channel 910 by $\alpha$, equal strength can be achieved, thus compacting the total dimension or weight of the channel required.

The use of aluminum alloy moldings formed by the extruding method by the present invention, compared with a case of existing steel press moldings, can eliminate the need for a reinforcing plate, etc., provide sufficient rigidity for a minimum sectional form and achieve light weight of extruded members by over about 35%.

A case where the extrusion molding method of the present invention is applied to a sash channel material will now be described.

Figure 22:
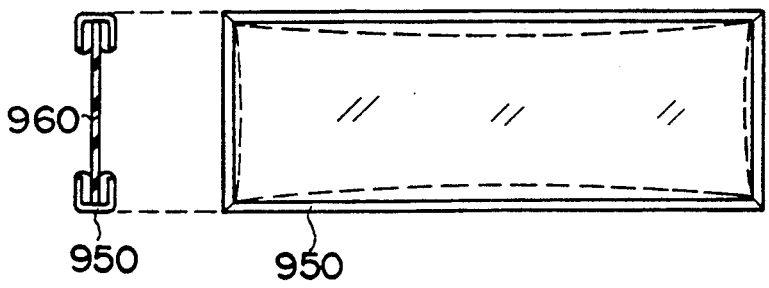
FIG. 22 is an explanatory drawing of a window part.
Figure 23:
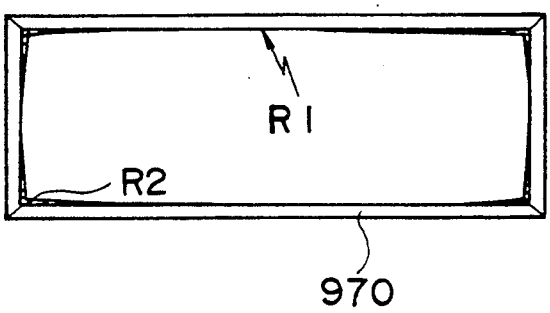
FIG. 23 is an explanatory drawing of a sash produced by the method of the present invention.
Figure 24:
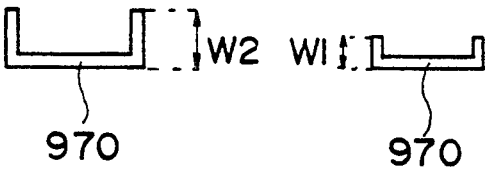
FIG. 24 is a partial explanatory drawing of a sash.
Figure 25:
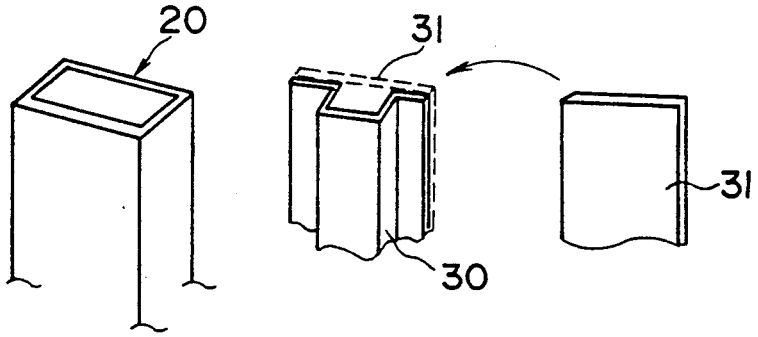
FIG. 25 is an explanatory drawing of an existing molding member.
Figure 26:
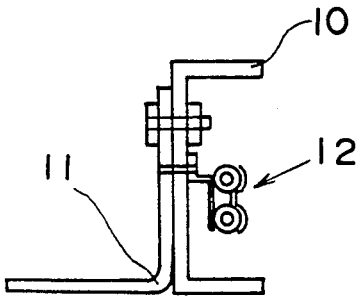
FIG. 26 is an explanatory drawing of a parts mounted state.
Figure 27:
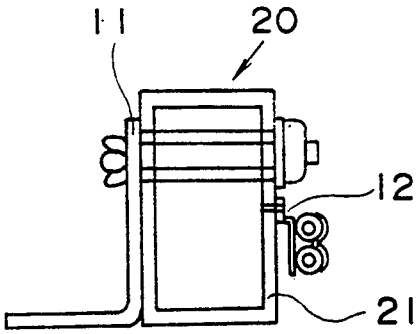
FIG. 27 is an explanatory drawing of a parts mounted state of a hollow structural member.
Figure 28:
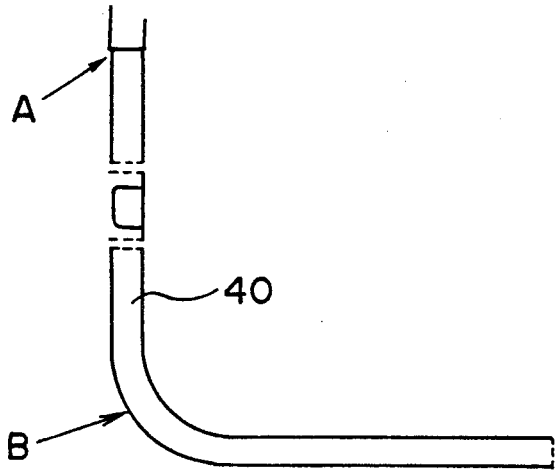
FIG. 28 is an explanatory drawing of an existing load-carrying platform consisting member.
Figure 29:
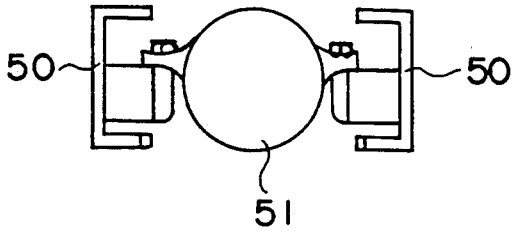
FIG. 29 is an explanatory drawing of a parts mounted state by an existing channel member.
Figure 30:
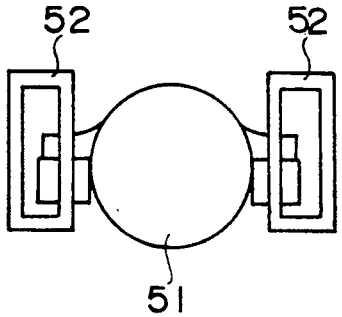
FIG. 30 is an explanatory drawing of a parts mounted state by a hollow structural member.
Figure 31:
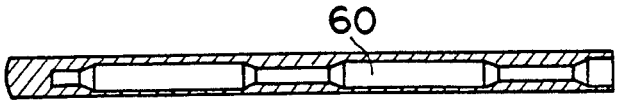
FIG. 31 is an explanatory drawing of a tube by an existing technique.
Figure 32:
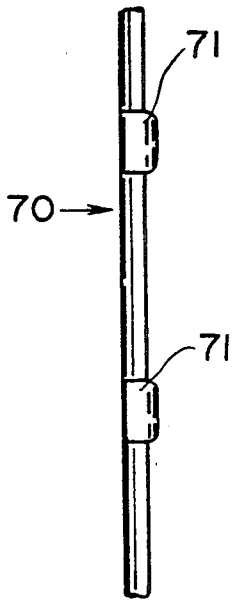
FIG. 32 is an explanatory drawing of an extruded rod by another existing technique.
Figure 33:
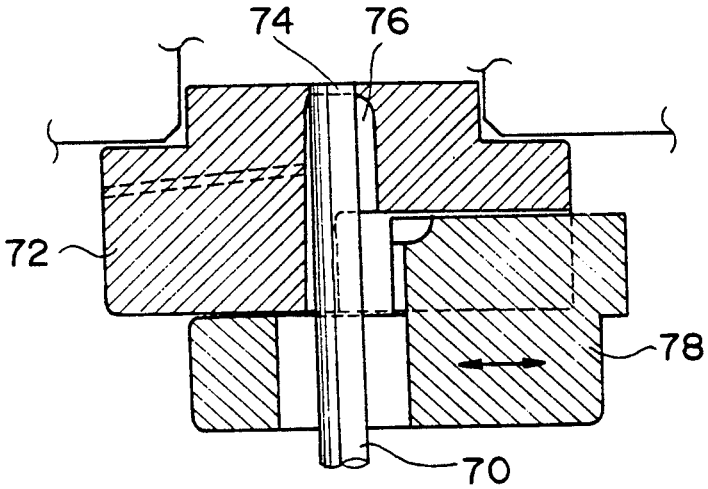
FIG. 33 is an explanatory drawing of an extruded rod molding machine.

FIG. 22 shows a plan view of a window area where a sash channel material 950 constant in width and height along the edge of a window panel is disposed. In this case, a visual range is shown by chain lines. This visual range can be modified by diminishing the sash height W, of the plane area R1 of the sash channel material 970 and by increasing the sash height W2 of the corner area R2. Therefore, the correction of this visual range can be achieved by constructing the slidable die so as to slide in the sash height forming area.

As described above, members partially different in the sectional form of a desired portion can easily be formed by extruding a material while gradually changing a die hole shape. Molding members, with necessary portions thereof enlarged or unnecessary portions diminished have no excess portions, thereby improving service efficiency thereof. Furthermore, sashes using a channel material with partially different sectional forms do not need after-machining of run-in, etc. for visual shape-up or appearance modification, thus reducing the machining jobs for modification.

Combined dies used for the extruding method for forming members partially different in sectional form are simple in composition, enabling members of desired forms to be molded. Furthermore, moldings with any die hole area can be molded by adjusting the moving rate of a slidable die and the extrusion rate of a material.

The die hole of a fixed die having an assumable maximum area of a member, various changes desired in form can be coped with by adding a slidable die to the composition.

I claim:

1. A method of extruding an aluminum alloy structural member with an open section, comprising the steps of:

extruding through at least one die hole a first portion of said structural member comprising at least one wall member; and extruding through an additional die hole, which extends longitudinally along and communicates with said at least one die hole, and through a third die hole which is slidably disposed over said additional die hole, a second portion of said structural member comprising an additional wall member connected to said at least one wall member and variably extending correspondingly longitudinally along the latter, the step of extruding said second portion including variably positioning said third die hole over said additional die hole.

2. The method of claim 1, wherein said at least one die hole is configured to define a structural member which comprises a base wall member, a first side wall member extending from a first section of said base wall member, and a second side wall member extending from a second section of said base wall member, said additional die hole is configured to extend from a section of said at least one die hole which defines said base wall member, and said third die hole is configured to have, in at least one of the variable positions of said third die hole, a part aligned and coinciding with a part of said at least one die hole corresponding to said base wall member and to have, in at least another of the variable positions of said third die hole, a part adapted to coincide with a part of said at least one die hole corresponding to one of said side wall members.

3. The method of claim 2, wherein said third die hole is configured to have, in a first of the variable positions of said third die hole, a part adapted to coact with said at least one die hole and said additional die hole so as to define an additional wall member which extends from a section of said base wall member.

4. The method of claim 2, wherein said third die hole is configured to have, in a second of the variable positions of said third die hole, a part adapted to coact with said at least one die hole and said additional die hole so as to define an additional wall member which extends from a section of said base wall member to a section of one of said side wall members.

5. A die set for extruding an aluminum alloy structural member with an open section, comprising:

a first die member having therein at least one die hole for extruding therethrough a first portion of said structural member comprising at least one wall member, and further having therein an additional die hole which extends longitudinally along and communicates with said at least one die hole; and a second die member having therein a third die hole, said second die member being selectively reciprocally slidable relative to said first die member transversely of and toward and away from the juncture between said at least one die hole and said additional die hole to dispose said third die hole over said additional die hole so as to enable the extrusion of said additional wall member so as to extend variably from said at least one wall member.

6. The die set of claim 5, wherein said at least one die hole comprises a plurality of die hole sections configured to define a structural member which comprises a base wall member, a first side wall member extending from a first section of said base wall member, and a second side wall member extending from a second section of said base wall member, and said additional die hole extends longitudinally of said at least one die hole and communicates with one of said die hole sections of the latter.

7. The die set of claim 6, wherein said additional die hole extends from and communicates with one of said die hole sections of said at least one die hole which defines said first and second side wall members.

8. The die set of claim 7, wherein said third die hole is configured to provide at least fourth and fifth die hole sections, with said fifth die hole section extending from one part of said fourth die hole section.

* * * * *